US009839565B1

(12) United States Patent
Harris

(10) Patent No.: US 9,839,565 B1
(45) Date of Patent: Dec. 12, 2017

(54) ANTI-TIP LATERAL TRANSFER SYSTEM

(71) Applicant: Gary M Harris, Kingsport, TN (US)

(72) Inventor: Gary M Harris, Kingsport, TN (US)

( * ) Notice: Subject to any disclaimer, the term of this patent is extended or adjusted under 35 U.S.C. 154(b) by 95 days.

(21) Appl. No.: 15/136,462

(22) Filed: Apr. 22, 2016

(51) Int. Cl.

| | |
|---|---|
| ***A61G 5/04*** | (2013.01) |
| ***A61G 5/00*** | (2006.01) |
| ***A61G 3/08*** | (2006.01) |
| ***A61G 3/06*** | (2006.01) |
| *A61G 5/10* | (2006.01) |

(52) U.S. Cl.
CPC ..... *A61G 5/04* (2013.01); *A61G 3/061* (2013.01); *A61G 3/0808* (2013.01); *A61G 5/00* (2013.01); *A61G 5/1089* (2016.11)

(58) Field of Classification Search
CPC ..... A61G 3/061; A61G 3/0808
See application file for complete search history.

(56) References Cited

U.S. PATENT DOCUMENTS 5,193,633 A 3/1993 Ezenwa
7,104,740 B2 * 9/2006 Girardin ..... A61G 3/0808 410/7
7,487,559 B1 2/2009 Denosky
7,752,687 B1 7/2010 Denosky
7,753,630 B2 * 7/2010 Jeppsson ..... A61G 3/0808 410/4
8,544,886 B2 10/2013 Noonan et al.
8,690,178 B2 4/2014 Griswold et al.
9,072,641 B2 * 7/2015 Ewing ..... A61G 3/0808

FOREIGN PATENT DOCUMENTS

JP 2011217963 A * 11/2011

* cited by examiner

*Primary Examiner* — Kevin Hurley
(74) *Attorney, Agent, or Firm* — Luedeka Neely Group, PC

(57) ABSTRACT

A lateral transfer system and method for transferring a patient between a fixed structure and a mobile vehicle. The system including A) a patient transfer device having a frame fixed to wheels and a carriage platform movably attached to the frame, the carriage platform having one or more extendable platform sections for lateral movement of the platform relative to the frame and wheels, and B) a stabilizer system for the patient transfer device. The stabilizer system including a portable platform having two opposing sloped ramps on a first and second sides thereof, a bracket fixedly attached to the platform adjacent a first end thereof, wherein the bracket is adapted for receiving a slide plate appendage attached to the frame of the patient transfer device, wherein the second end of the ramp has a length sufficient to prevent tipping of the platform during a patient transfer maneuver.

17 Claims, 12 Drawing Sheets

ANTI-TIP LATERAL TRANSFER SYSTEM

TECHNICAL FIELD

The disclosure relates to transfer devices and in particular systems that are suitable for safely transferring a patient from a wheelchair to a bed, toilet or examination table.

BACKGROUND AND SUMMARY

Wheelchair, bed, and wheeled base transfer technology has made great advances over the last two decades. The ability for the disabled to adapt to their physical issues regarding mobility is continually improving. However, mobility in the area of lateral transfer of a disabled patient from a wheelchair to a fixed structure and vice versa is an area where progress is slow and extremely challenging. The major challenges confronting progress in the development of lateral transfer devices include: 1. Patient safety 2. Simplicity of mechanical operation 3. Adapting inventive device to a powered motorized wheelchair without limiting mobility and angular carriage positioning and 4. Eliminating lifting of the patient by the care provider.

The ultimate challenge to securing patient safety during the lateral transfer process is maintaining horizontal stability of the wheelchair. Maintaining horizontal stability means that the transfer carriage will remain level (non-tipping) and will not rotate in a clockwise or counterclockwise direction (resulting from tipping) during the transfer process. Tipping occurs when a wheel or wheels on the opposite side of the transfer device begin(s) to move vertically as weight transfers to the opposite side of the wheelchair.

U.S. Pat. No. 8,544,866 is an example of a transfer device that places a patient's safety at risk due to potential tipping of the carriage during patient transfer. The patented device of the '866 patent uses a transport carriage comprised of tracks with wheels that travel along the track allowing the carriage to move laterally over the fixed structure. However, the device depends on the mattress to account for horizontal stability. The weight of the patient and carriage structure may depress a soft mattress two or three inches allowing for a potential dangerous weight transfer and tipping of the device during patient transfer. The '866 patent also has exposed wheels and tracks under the carriage seat that could potentially entangle with sheets creating an unsafe transfer operation.

U.S. Pat. No. 5,193,633 is another example of a lateral transfer device that is devoid of any device that would prevent tipping during patient transfer. The '633 also has a limited distance of carriage transfer capability (0-8 inches), therefore creating an unsafe transfer between the transfer devise and various stretcher beds and gurneys where mattresses are inset within the structures and offset from the frame works of the structures.

The complexity of the operation of lateral transfer devises trigger concerns regarding the time involved in the overall transfer process and the building of additional framing structures to the wheeled base frame and bed. U.S. Pat. No. 7,752,687 B1 describes a transfer device requiring the inflating of air bags on a bed, extending a frame attached to the wheeled base frame through the channels of the air bags, building a stretcher on the extended framing, and attaching a transfer sheet to the stretcher. The device of the '687 patent is not only time consuming in operation but the patient becomes totally dependent on care providers for the entire transport process.

Another major challenge impeding the progress of the patient lateral transfer process is the need for a transfer device and that can be mounted onto a wheeled base structure without intruding on the mobility and angular positioning abilities of the travel carriage. Some conventional transfer chairs typically fail to offer the disabled person the mobile independency they need for ever day life.

Finally, the challenge is to provide the patient care provider with a lateral transfer device that eliminates the need to lift the patient, pull the patient on a slide board, or load the patient into a sling or harness. Liability issues relating to injuries occurring via patient lifting have become a major concern in the health care industry. Also, care providers are often the patient's spouse, an elderly relative or person, or individuals that are physically incapable of moving the disabled person without additional help. Therefore, enhancing the need for a lateral transfer device that is safe, simple in operation, and adaptive to a powered wheeled structure without limiting the mobile structure's movement capabilities is essential.

U.S. Pat. No. 8,690,178 describes transfer of a patient from a wheelchair to a bed and vice versa. The foregoing device uses a complicated docking system between a hospital bed and wheeled base structure. The foregoing transfer system offers a unique and credible way for a disabled patient to maneuver from a bed to a wheeled base structure. However, the invention limits a patient's ability to transfer to various hospitals, homes, or hotel style beds that don't offer the specific docking system needed by the transfer device.

In view of the foregoing, one embodiment of the disclosure provides a stabilizer system for a patient transfer device for transferring a patient between a fixed structure and a mobile vehicle or between two mobile vehicles. The stabilizer system includes a portable platform having two opposing sloped ramps on a first side and a second side thereof. A bracket is fixedly attached to the platform adjacent a first end thereof between the sloped ramps. The bracket has opposed shoulders, an entrance side and an exit side opposite the entrance side, wherein the bracket is adapted for receiving a slide plate appendage attached to a wheeled transfer vehicle when the wheeled transfer vehicle is positioned on the platform between the sloped ramps and between the first end and a second end of the ramp. The second end of the ramp has a length sufficient to prevent tipping of the platform during a patient transfer maneuver between the wheeled transfer vehicle and a fixed structure or mobile vehicle.

Another embodiment of the disclosure provides a lateral transfer system for transferring a patient between a fixed structure and a mobile vehicle or between two mobile vehicles. The system includes a patient transfer device having a frame fixed to wheels and a carriage platform movably attached to the frame. The carriage platform has one or more extendable carriage platform sections for lateral movement of the carriage platform relative to the frame and wheels for transferring a patient between the patient transfer device and a fixed structure or a wheeled vehicle. A stabilizer system for the patient transfer device is also provided by the transfer system. The stabilizer system includes a portable platform having two opposing sloped ramps on a first side and a second side thereof. A bracket is fixedly attached to the platform adjacent a first end thereof between the sloped ramps. The bracket has opposed shoulders, an entrance side and an exit side opposite the entrance side. The bracket is adapted for receiving a slide plate appendage attached to the frame of the patient transfer device when the patient transfer device is positioned on the platform between the sloped ramps and between the first end and a second end of the ramp. The second end of the ramp has a length sufficient to prevent tipping of the platform during a patient transfer maneuver.

A further embodiment of the disclosure provides a process for transferring a patient between a fixed structure and a mobile vehicle or between two mobile vehicles. The process includes providing a patient transfer device having a frame fixed to wheels and a carriage platform movably attached to the frame. The carriage platform has one or more extendable carriage platform sections for lateral movement of the carriage platform relative to the frame and wheels for transferring a patient between the patient transfer device and a fixed structure or a wheeled vehicle. A stabilizer system is provided for the patient transfer device. The stabilizer system includes a portable platform having two opposing sloped ramps on a first side and a second side thereof. A bracket is fixedly attached to the platform adjacent a first end thereof between the sloped ramps. The bracket has opposed shoulders, an entrance side and an exit side opposite the entrance side. The bracket is adapted for receiving a slide plate appendage attached to the frame of the patient transfer device. The second end of the ramp has a length sufficient to prevent tipping of the platform during a patient transfer maneuver. During use, the patient transfer device is positioned on the platform between the sloped ramps and between the first end and a second end of the ramp so that the slide plate is engaged with the bracket. The carriage platform is then laterally moved to move the patient from the patient transfer device to a fixed structure or a mobile vehicle.

Accordingly, the aforementioned challenges have all been addressed by embodiments of the disclosure. The unique design of the transfer carriage may improve safety and add to the ease of transitioning a patient on and off of the carriage. The transfer carriage is designed to shield the mechanical operations system so as to avoid bed sheets or medical devices becoming entangled in the mechanical system during the transfer process.

BRIEF DESCRIPTION OF THE DRAWINGS

Features and advantages may be further understood by reference to the drawings and detailed description presented herein.

DETAILED DESCRIPTION OF EXEMPLARY EMBODIMENTS

Figure 1:
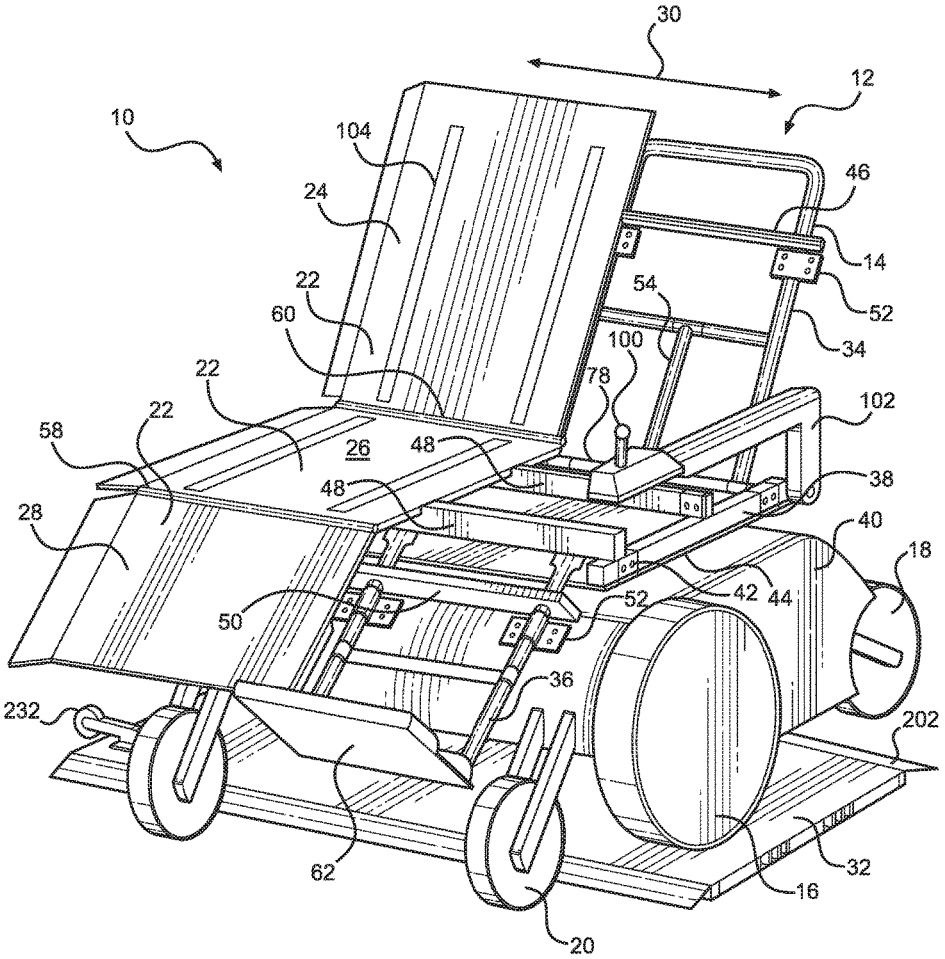
FIG. 1 is a perspective view, not to scale of a lateral transfer system according to the disclosure with a transfer carriage in lateral position relative to a wheeled base.

With reference to the drawing, various features and advantage of the disclosed embodiments are illustrated. In FIG. 1 there is shown in perspective view, a lateral transfer system 10 according to the disclosure. The system 10 includes a patient transfer device 12 that includes a frame 14 fixed to wheels 16, 18 and 20, and a carriage platform 22 movably attached to the frame 14 and having one or more extendable carriage platform sections 24, 26 and 28 movably attached to the frame 14 for lateral movement of the carriage platform 22 in the direction of arrow 30 relative to the frame 14 for transferring a patient between the patient transfer device 12 and a fixed structure such as a bed or toilet or a wheel chair, for example. The system 10 further includes a stabilizer system 32 for the patient transfer device 12 described in more detail below.

As shown in FIG. 1, the patient transfer device 12 includes a tubular frame 14 that has three adjoined sections, a head section 34, a foot section 36 and a seat section 38 hingedly attached to both the head section 34 and the foot section 36. Each of the sections 34, 36 and 38 may include round or rectangular tubing, with the at least the seat section 36 having rectangular tubing for additional strength. The seat section 36 may be fixedly mounted to a wheeled base 40 using sleeves 42 bolted to the wheel section 40 or may be mounted to a lifting plate 44 for elevating the entire carriage platform 22. The wheeled base 40 may include a motor for moving the patient transfer device 12 and actuators for lifting the lifting plate 44 to elevate the carriage platform 22 above the wheel section 40. Lateral transfer of a patient on the patient transfer device 12 is provided by telescopic slide 46 on the head section 34, telescopic slides 48 on the seat section 38 and telescopic slide 50 on the foot section 36. In one embodiment, the head section 34 includes a single telescopic slide 46, the seat section 38 includes two telescopic slides 48 and the foot section 36 includes a single telescopic slide 50. Slide couplings such as slide coupling 52 attached slides 46 and 50 to the sections 34 and 36. The slide couplings enable the carriage foot section 36 and head section 34 relative to the frame sections 34 and 36 as the angular position of the head section 34 and foot section 36 are changed. The strength of each section 34, 36, and 38 is important because they aid in supporting the entire assemblage of the transfer device 12. The head section 34, foot section 36 and seat section 38 made from various metals, aluminum, alloys, and the like.

While the embodiments described herein provide for multiple carriage platform sections 24-28 for attaching to a wheel base 4, the described transfer system 10 is also applicable to a transfer device 12 having a single carriage section, two carriage sections or more than three carriage sections. The platform sections 24, 26, and 28 of the carriage platform 22 may be made from various metals, aluminum, alloys, rigid plastic, fiberglass, and the like.

The telescopic slides 46, 48 and 50 provide the patient transfer device 12 with strength and mobility with a minimal amount of friction. Suitable telescopic slides 46-50 may be ball bearing slides having a height dimension of about 28 millimeters, a width dimension of about 26 millimeters, a length L of from 290 to 600 millimeters, a radial static load of 649 N and an axial static load of 379 N. The foregoing telescopic slides enable safe transfer of a patient from the center of the wheel based device (1) to a lateral distance from the center of the wheel based device (1) ranging from about 300 millimeters to about 600 millimeters. The telescopic slides 46-50 are mounted horizontally to the frame 14 of patient transfer device 12 as shown in FIG. 1. In alternative embodiments, a variety of bottom mount slides, ball bearing slide, and/or solid bearing slides may be used as the telescopic slide mechanisms to move the carriage platform 22. A safety latch may be used to keep the lateral transfer system closed when used in a manual mode. Stops may also be provided on the telescopic slides 46-50 to limit the travel distance of the slides when used in a manual or automatic mode.

Actuators, such as actuator 54 may be attached to the head section frame 34 and actuator 56 (FIG. 2) may be attached to the foot section frame 36 to raise and lower the head section 34 and foot section 36 to change the patient position from a seated to a lying position and vice versa. The platform section 28 is hingedly attached to the platform section 26 by hinge 58 and the platform section 24 is hingedly attached to the platform section 26 by hinge 60. One or more foot rests 62 may be attached to the foot section 36. The foot rests 62 remain attached to the main frame 14 as the carriage platform 22 slides to the extended or lateral position. Otherwise, the foot rests 62 may infringe on the movement of the patient's legs during the transfer process if they traveled with the carriage platform 22.

Figure 2:
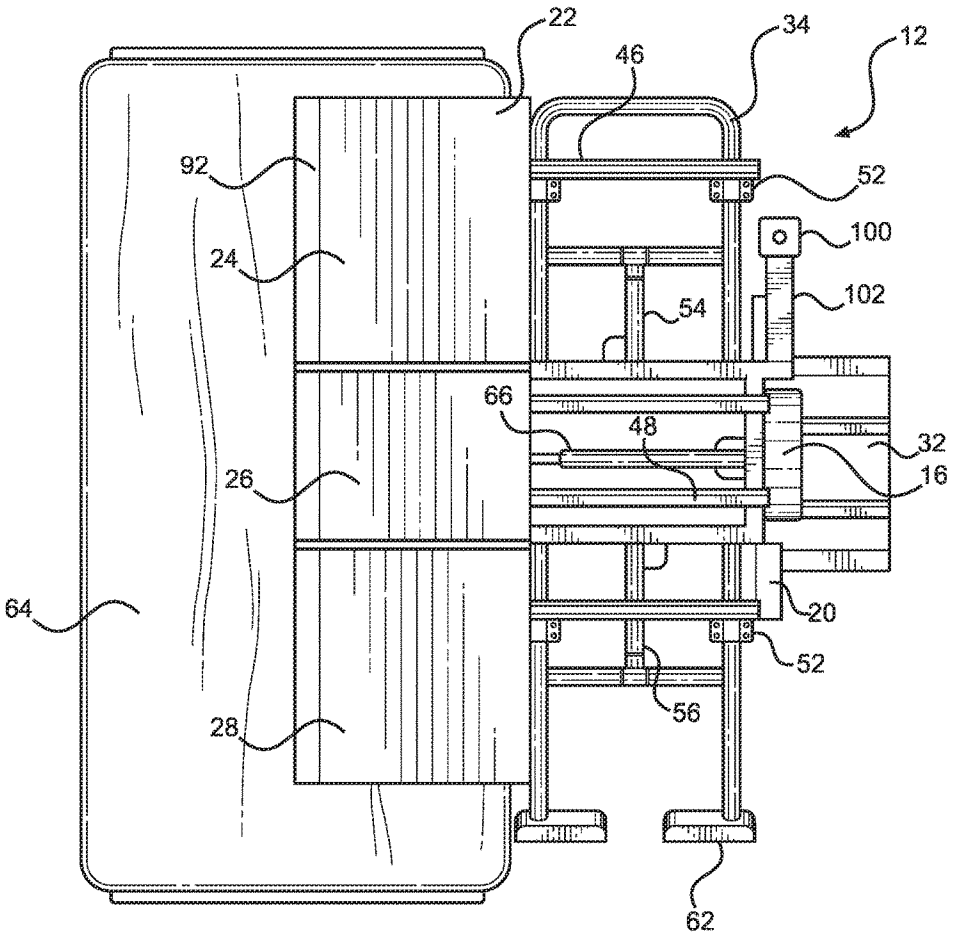
FIG. 2. is a top plan view, not to scale, of the lateral transfer system of FIG. 1 with a transfer carriage extended over a bed.
Figure 4:
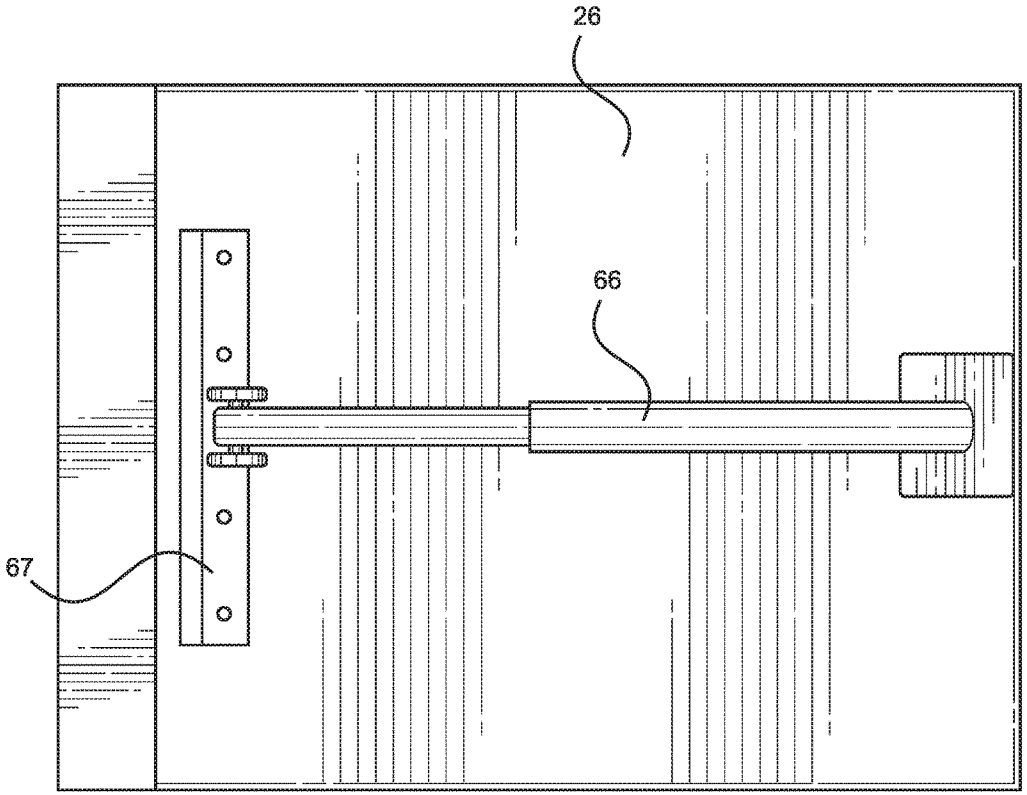
FIG. 4 is a plan bottom view, not to scale, of an actuator attached to a portion of a transfer carriage for the transfer system of FIG. 1.

As shown in FIG. 2, the carriage platform 22 containing sections 24, 26 and 28 is extended over a bed 64 transfer of a patient from the patient transfer device 12 to the bed 64. Lateral translation of the carriage platform 22 may be effected manually or automatically, as by actuator 66 as shown in FIG. 4. The actuator 66 may be attached to the carriage platform 22 between the telescopic slides 48 or may be attached to a cover plate for the telescopic slides, if used, by means of a support bracket 67. Various telescopic slide lengths and actuator lengths with specific weight load capacities may be used in accordance with the size of chair needed.

Figure 5A:
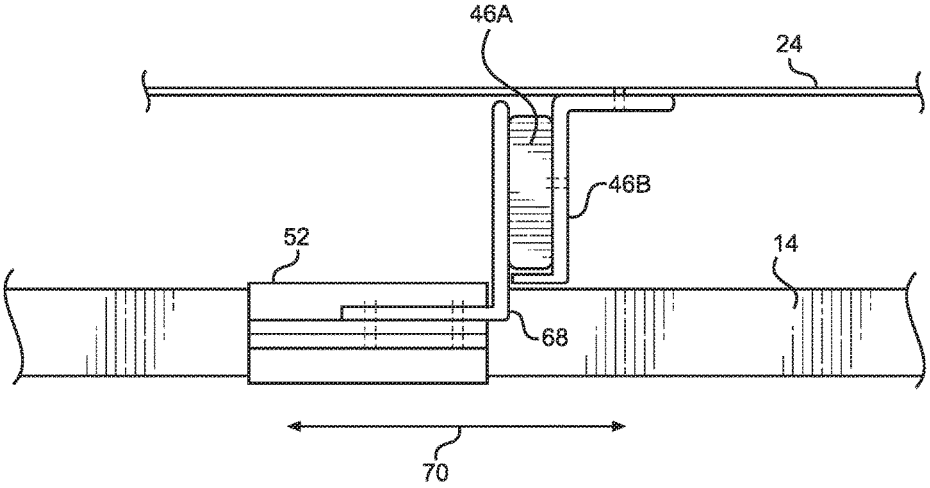
FIG. 5A is a side view, not to scale, of a telescopic slide and slide coupling attached to a frame of a transfer vehicle for the transfer system of FIG. 1.
Figure 5B:
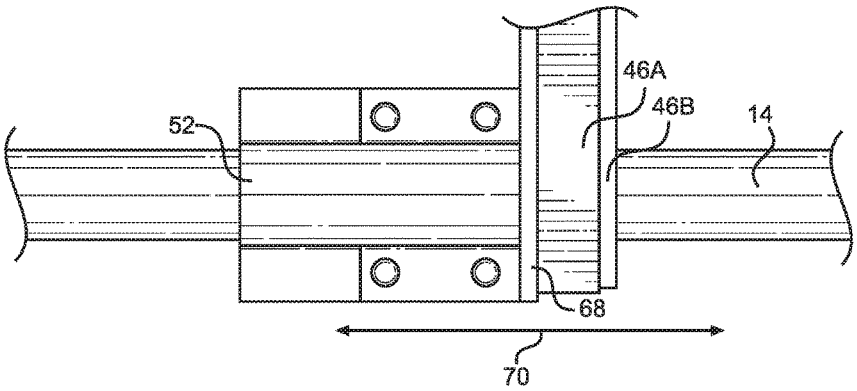
FIG. 5B is a top plan view, not to scale, of the telescopic slide and slide coupling of FIG. 5A.

Further details of the telescopic slides and slide couplings can be found in FIGS. 5A and 5B, FIG. 6, FIG. 7, FIG. 8 and FIGS. 9A and 9B. On the platform section 24 and head section 34, the telescopic slide 46, consisting of slide components 46A and 46B, is attached to the frame 14 of the transfer devices 12 by a slide coupling 52 as shown in FIGS. 5A and 5B. An L-shaped bracket 68 attaches the slide 46 to the slide coupling 52. The slide coupling 52 is configured to slide in the direction of arrow 70 along the frame 14 as the platform section 24 and head section 34 are raised and lowered. The contact surfaces of the slide coupling 52 may be made of a low friction material such as polytetrafluoroethylene, or may include bearings or other low friction structures. The L-shaped bracket 68 is designed to be unbolted from the frame 14 or from the telescopic slide 46. This design allows the entire carriage platform 22 to be removed from the transfer device 12 without removing all or parts of the frame 14. In an alternative embodiment, the slide coupling 52 may be of one-piece construction that is slid onto the frame 14. The slide couplings 52 are unique components of the transfer device 12 and are specifically designed to assist the powered/manual wheelchair or any wheeled base structure in enabling a patient lateral transfer system to function without inhibiting the tilt, recline, and elevating movements of the patient transfer device. The slide couplings 52 allow a patient to be laterally transferred from a wheeled base structure from any angular position and also allows a patient to rest in a pressure reduction posture when needed. Accordingly, the frame 14 of the head section 34 is preferably made of circular tubular members that enable sliding and/or rotation of the slide couplings 52 relative to the frame 14. The same type of slide couplings as slide couplings 52 is used on the foot section 36 for the platform section 28 for raising and lowering the foot section 38 with respect to the seat section 38.

Figure 6:
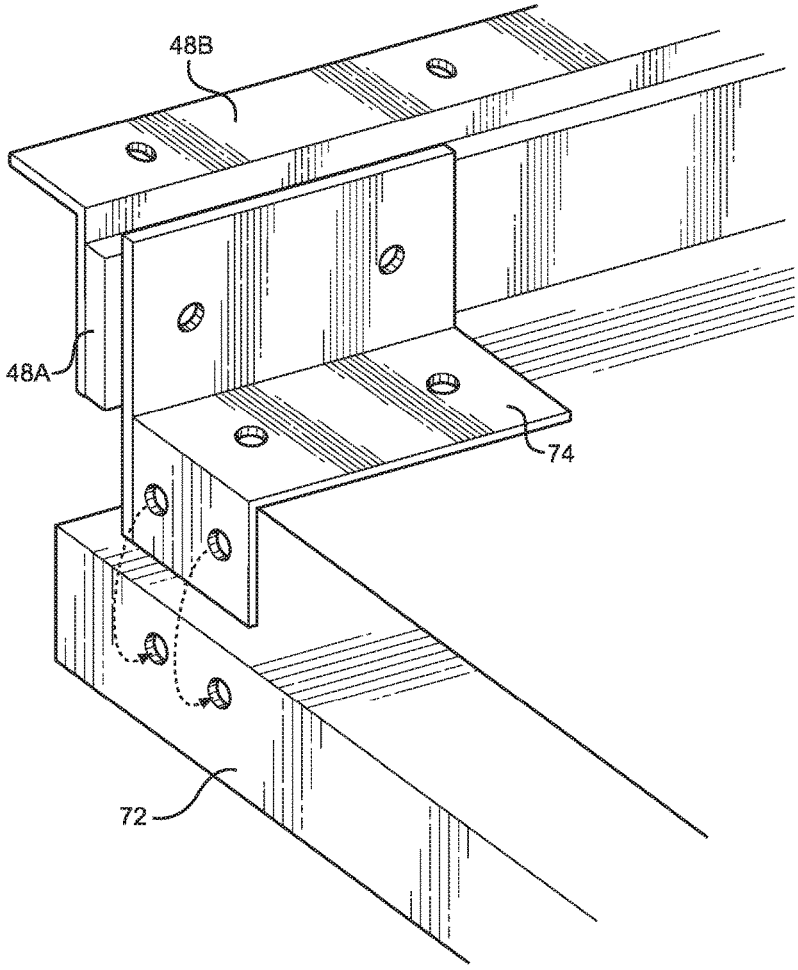
FIG. 6 is a perspective view, not to scale, of a telescopic slide and fixed bracket for attachment to a rectangular tubing member of a frame of a transfer vehicle for the transfer system of FIG. 1.

With respect to the seat section 38, the telescopic slides 48, consisting of slide components 48A and 48B, are fixedly attached to a rectangular tubular member 72 using a fixed sleeve or L-shaped bracket 74 as shown in FIG. 6. The L-shaped bracket may be bolted directly to the rectangular tubular member 72 and to slide component 48A. As described above, the seat section 38 is attached to the wheeled base 40 or to a lifting plate 44 for horizontal movement thereof, but is not angularly positioned relative to the head section 36 or foot section 38. Accordingly, the two telescopic slides 48 being fixedly attached to the rectangular tubular member 72 provide strength to the patient transfer device 12 when the carriage platform 22 is extended away from the wheeled base 40.

Figure 7:
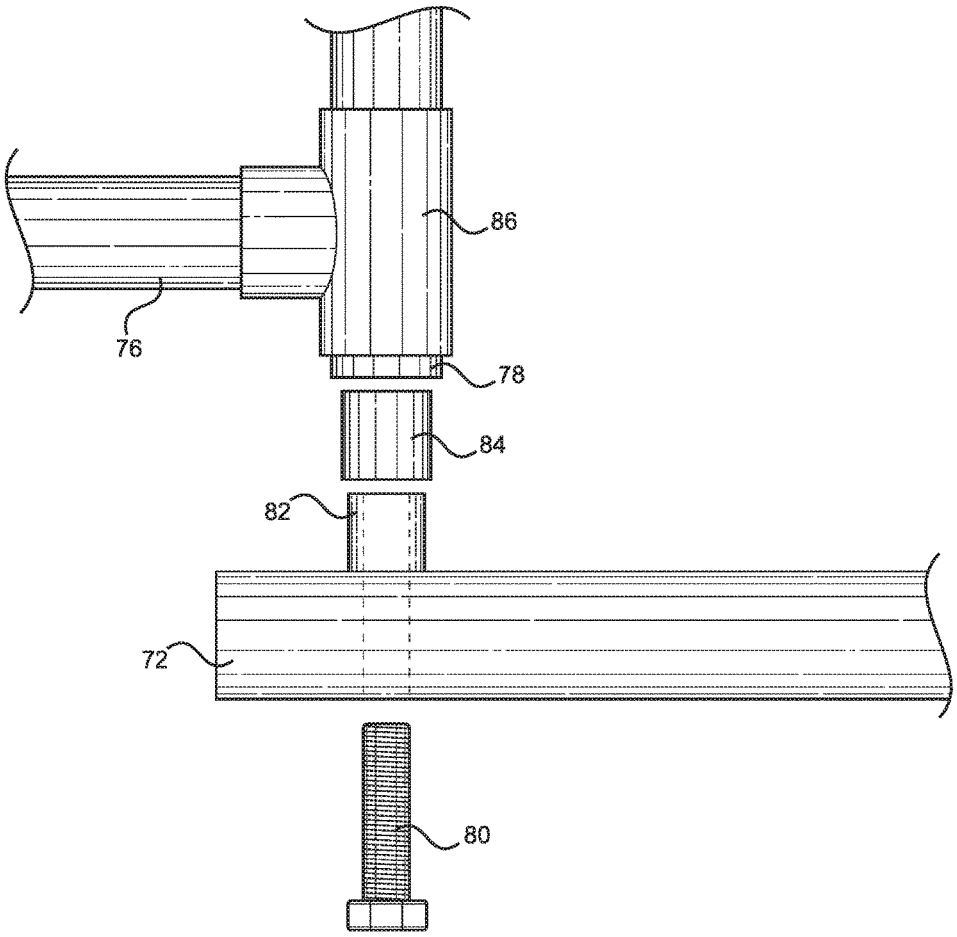
FIG. 7 is a top plan view, not to scale, of a hinge assembly for a movable frame section of a transfer vehicle for the transfer system of FIG. 1.

FIG. 7 illustrates a structure for hingedly connecting the rectangular tubing member 72 of the seat section 38 to the head section 34 and/or foot section 36. The structure shown in FIG. 7 enables the foot section 36 or head section 34 of the main frame 14 to change angular positioning as the tilting, reclining, and elevating features of the device 12 are activated. The back section 34 includes a tubular member providing a side section 76 of the back section 34 and a tubular member providing a hinge structure 78 for hingedly connecting the back section 34 to the seat section 38. The hinge structure 78 is disposed substantially perpendicular to the rectangular tubing member 72 of the seat section 38. A bolt 80 is passed through the rectangular tubing member 72 and into a threaded plug 82 that may be inserted into the hinge structure 78. The threaded plug 82 is fixed to the bolt 80 and is sized to rotate within the hinge structure 78. However, for added strength, a tubular coupling 84 may be disposed in the hinge structure 78 for added strength and the plug 82 inserted into the coupling 84. Accordingly, the coupling 84 may rotate within the hinge structure 78 and may be fixedly attached to the threaded plug 82. In an alternative embodiment, the threaded plug 82 may also rotate within the coupling 84. A T-shaped coupling 86 adjoins the side section 76 of the back section 34 to the hinge structure 78. The foregoing description also applies to the foot section 36 and its connection to the seat section 38.

The adaptability of the patient transfer device 12 begins with a supportive tubular frame 14 consisting of three adjoined sections 34, 36, and 38 as shown in FIG. 1. The seat section 38 comprises rectangular tubing members 72 on each side and round tubing for the hinge members 78 on the front and back. Attachment sleeves mounted to the seat section 38 may be bolted to the powered wheel base 40 or to the lifting plate 44 to secure the frame 14 to the base 40. The frame 14 becomes the main upper or seat section frame of a manual wheel base structure. Lateral movement of the carriage platform 22 is provided by the telescopic slides attached to the head section 34, seat section 38, and foot section 36 of the main frame 14. The head section 34 and foot section 36 each use one telescopic slide 46 and 50 respectively, the seat section uses two telescopic slides 48. The head and foot slides 46 and 50 are attached to the frame 14 by the slide couplings 52 described above. The slide couplings 52 enable the carriage platform sections 24 and 28 to move up and down on the main frame tubing as angular positioning of the carriage platform 22 changes. The telescopic slides 46-50 provide the carriage platform 22 with strength and mobility with a minimal amount of friction.

Figure 8:
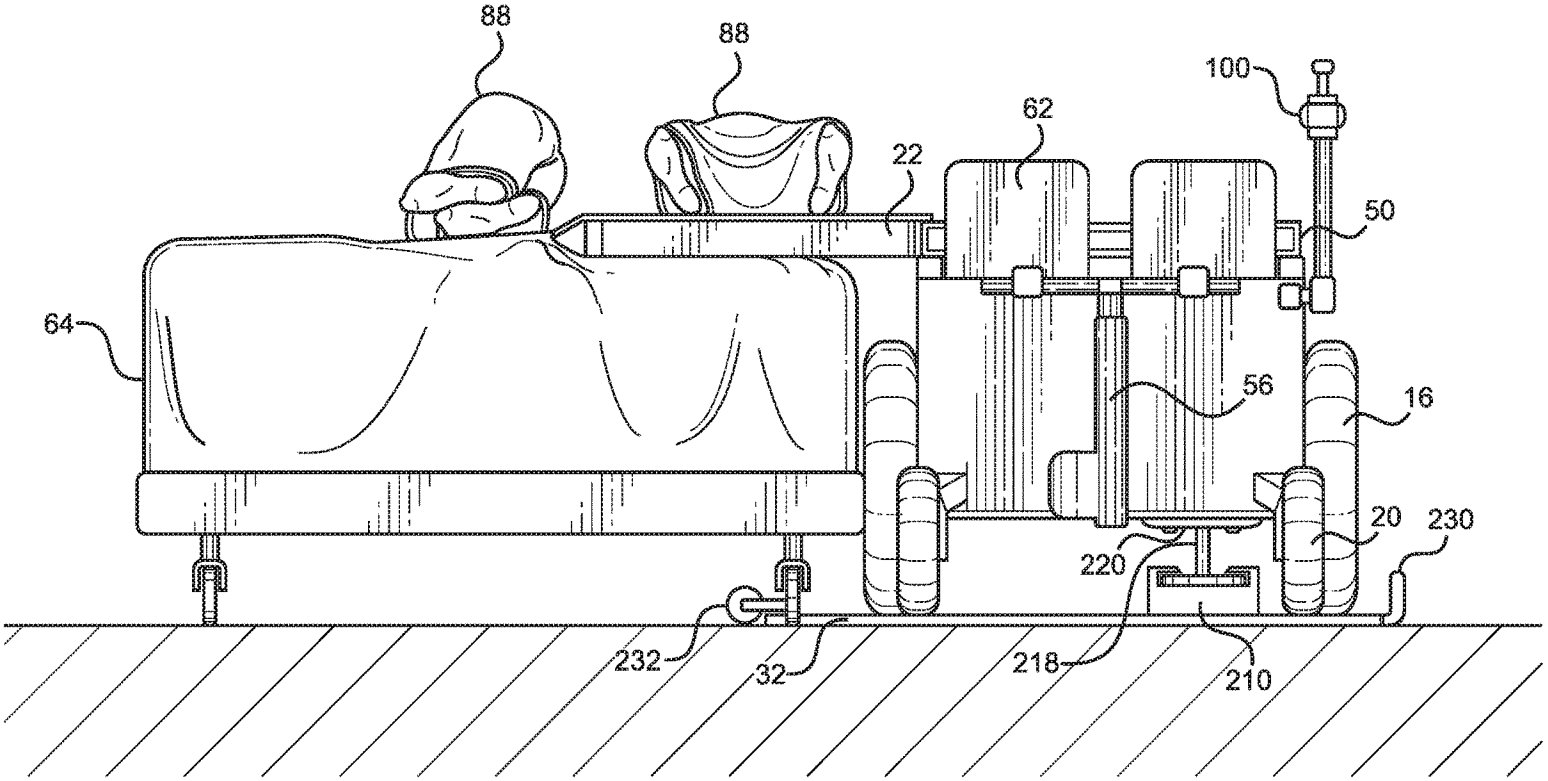
FIG. 8 is an end elevational view, not to scale, of a transfer system of FIG. 1 in use for moving a patient between a bed and a transfer vehicle

The patient transfer device 12, described herein is designed for vertical landing on whatever surface the transfer is going to take place on as shown in FIG. 8. FIG. 8 is a front view of a patient 88 transferring onto a bed 64 with a vertical compression of the mattress of the bed 64 by the carriage platform 22. A vertical landing or a vertical compression method implies that the carriage platform 22 is extended over the bed 64 and then slowly lowered to the surface of the bed 64 where the transfer will take place. The vertical compression method of transfer eliminates tangling of sheets or other bedding materials that could create safety concerns that could result from transfer devices that slide across the mattress of the bed 64. The mechanical operations of the patient transfer device 12 were designed to function with wheeled base devices that have elevation features that are essential for vertical compression transfer techniques. Manual wheelchairs without elevation features can use bed/medical testing tables of various types with elevating features to get the same transfer positioning capabilities as the patient transfer device 12 described herein. In one embodiment, the carriage platform 22 may be sloped toward the bed 64 to permit an easy on/off patient transfer particularly when the vertical landing is on a surface that is more rigid than mattresses.

Figure 9A:
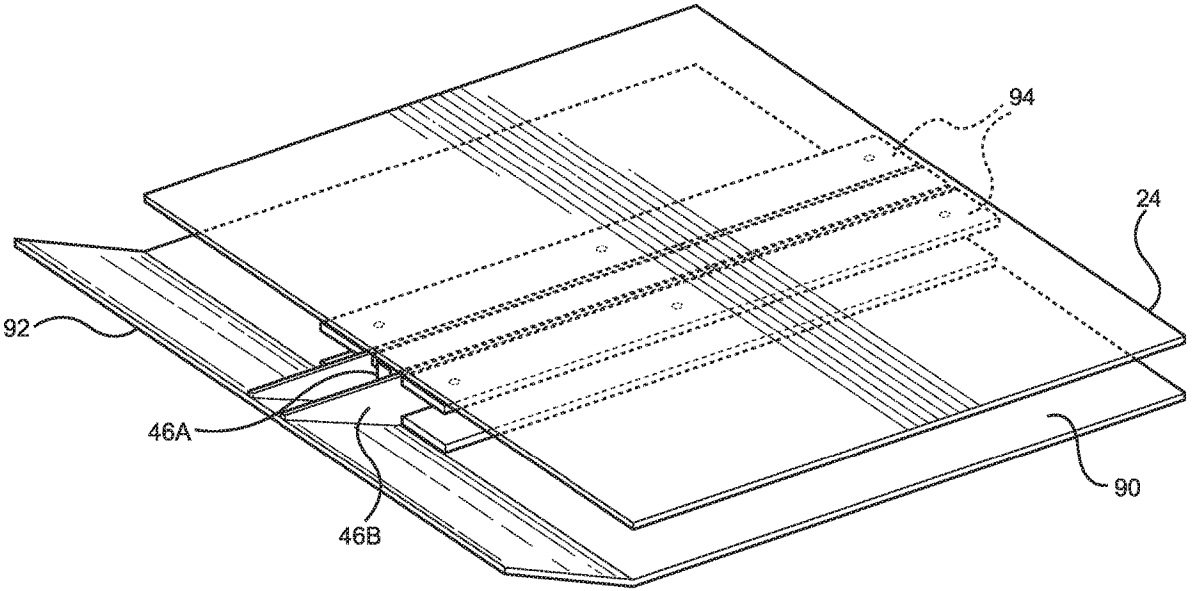
FIG. 9A is a perspective view, not to scale, of a cover plate for telescopic slides for a carriage platform for the transfer system of FIG. 1.
Figure 9B:
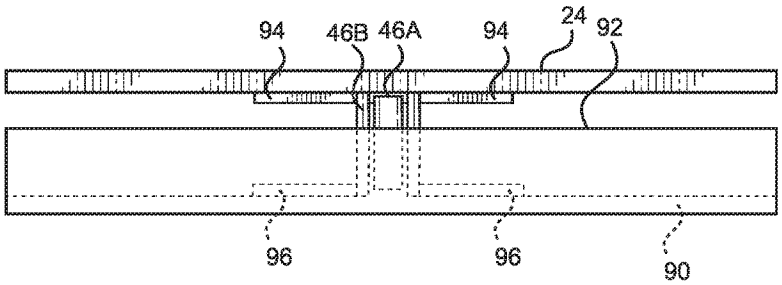
FIG. 9*b* is an end view, not to scale, of the cover plate and carriage platform of FIG. 9A.

When transfer of the patient 88 is achieved by sliding the carriage platform 22 over a bed or other surface, a lower cover plate 90 may be used as shown in FIGS. 9A and 9B for the telescopic slides 46-50 and platform sections 24-28. Only platform section 24 and telescopic slide 46A and 46B are illustrated in FIGS. 9A and 9B. In FIG. 9A, the platform section 24 is not shown. Accordingly, the cover plate 90 for telescopic slide 46A and 46B is used to eliminate the slide 46 from entangling in sheets, blankets, or medical equipment. Accordingly, in this embodiment, each of the telescopic slides 46-50 is protected with the cover plate. The cover plate 90 moves with the telescopic slide 46B and shields the slide from bed coverings. A transfer end of the slide 46 and cover plate 90 is protected by a nose piece 92 that prevents bed sheets and other objects from entangling in the slide mechanism. Flanges 94 connect the platform section 24 to the slide 46 and flanges 96 connect the cover plate 90 to the slide 46. The cover plate 90 may contain a coating of low friction material to make sliding of the cover plate 90 over a surface easier. Likewise, the surfaces of platform sections 24-26 may be coated with a low friction material.

A control mechanism 100 mounted on an arm 102 of the patient transfer device 12 (FIG. 1) may be used to not only control the movement of the patient transfer device 12 onto and off of the stabilizer system, it may also be used to activate the actuator 66 for lateral movement of the carriage platform 22, or for angular movement of head section 34 and/or foot section 36. An arm on an opposite side of the transfer device 12 from arm 102 may be hingedly mounted to the rectangular tubular member 72 or to the frame 14 for rotating the arm out of the way for lateral movement of the carriage platform 22. In one embodiment, hook and loop fastener strips 104 may be applied to each of the platform sections 24-28 so that a patient may attach personalized cushions to the sections 24-28.

With reference again to FIG. 1, the patient transfer device 12 is mounted to the wheeled base 40 which may be a conventional wheelchair or a powered wheelchair. Typically, the wheeled base 40 will have two large wheels 16 generally located in the middle of the wheeled base 40 between two forward wheels 20 and two rear wheels 18. The two forward wheels 20 and two rear wheels 18 function to resist against clockwise and counter clockwise movement of the transfer device 12. The clockwise and counter clockwise movement of the transfer device 12 would not be a factor if the weight of the patient was equally divided between all three platform sections 24-28. However, the platform sections 24 and 26 are heavier than the platform section 28 and thus, without the stabilizing wheels 18 and 20, the device will tend to rotate either clockwise or counterclockwise around wheels 16.

Figure 10:
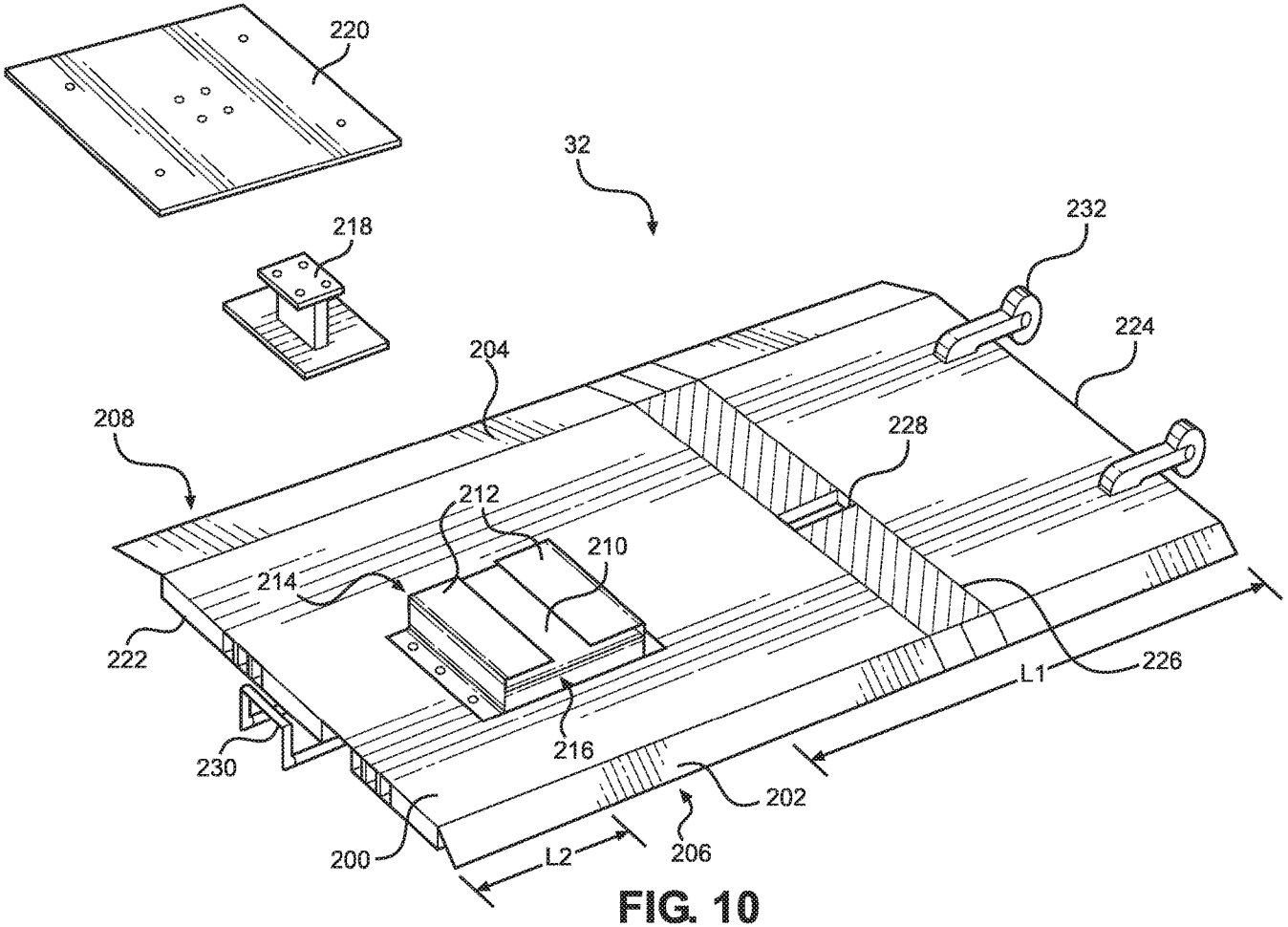
FIG. 10 is a perspective view, not to scale, of a portable stabilizer system for the transfer system of FIG. 1.
Figure 11:
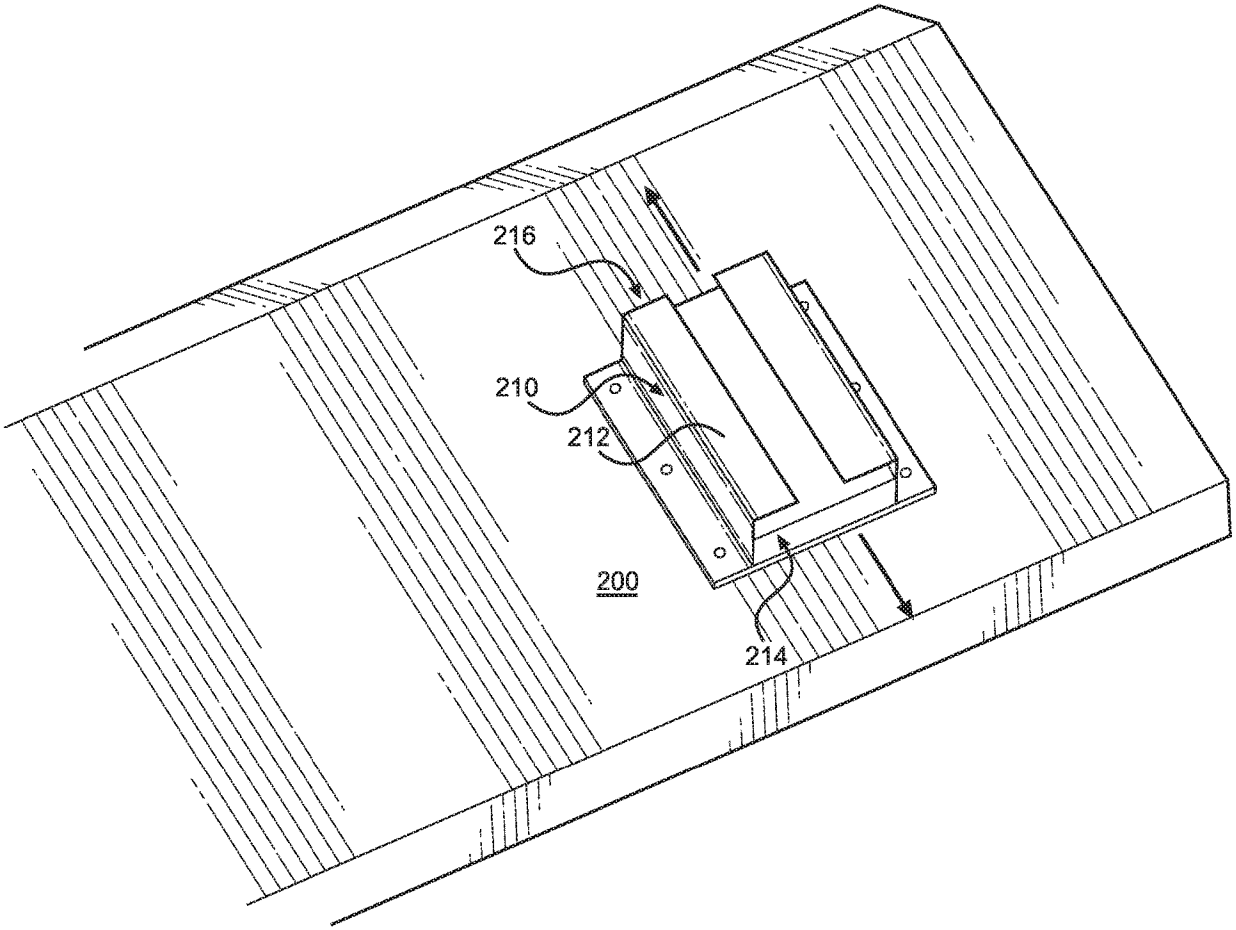
FIG. 11 is a perspective view, not to scale, of a portion of the portable stabilizer system of FIG. 10.
Figure 12:
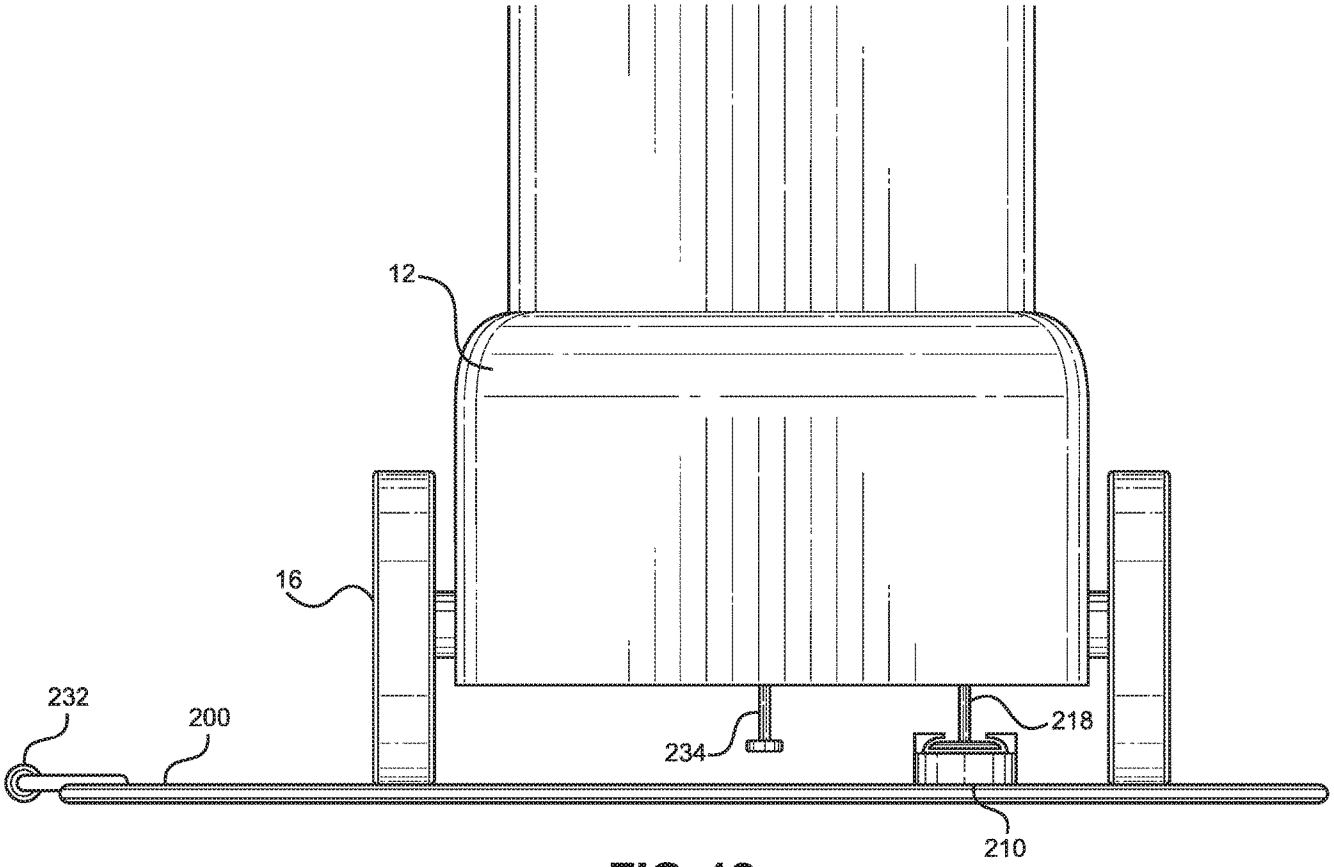
FIG. 12 is a front schematic view, not to scale, of a transfer vehicle docked on the portable stabilizer system of FIG. 10.

An important feature of the disclosed embodiments is the stabilizer system 32 shown in FIGS. 10-12. The stabilizer system 32 is adapted for use with any wheelchair or transfer device, but is specifically adapted to prevent tipping of the transfer device 12 when the carriage platform 22 is fully extended laterally from the transfer device 12. The stabilizer system 32 includes a portable platform 200 having two opposing sloped ramps 202 and 204 on first and second sides 206 and 208 thereof. A bracket 210 is fixedly attached to the platform 200 between the sloped ramps 202 and 204. The bracket 210 has opposed shoulders 212, and entrance side 214 and an exit side 216 and is adapted for receiving a slide plate appendage 218 therein between the shoulders 212. The slide plate appendage 218 may be attached to an underside of the transfer device 12 or the frame of a wheel chair by a mounting plate 220. The slide plate appendage 218 is engaged with the bracket 210 when the transfer device 12 is positioned properly on the platform 200 between the sloped ramps 202 and 204 and between a first end 222 and a second end 224 of the platform 200. As shown in FIG. 10, the bracket 210 is mounted closely adjacent to the first end 222 of the platform 200 so that length L1 is much greater than length L2. Length L1 is selected to prevent tipping of the platform and transfer device 12 attached to the platform through appendage 218 and bracket 210 when the carriage platform 22 of the transfer device is extended over end 224 of the platform. Accordingly, a wheel guide 226 may be provided on the platform 200 to provide guiding placement of the transfer device 12 on the platform. The platform 200 may also include a slot 228 for engaging wheel 16 of the transfer device 12 to indicate when the transfer device is properly positioned on the platform 200.

A handle 230 may be attached to the first end 222 of the platform 200 for lifting and moving the platform 200 to a transfer position. The second end 224 of the platform 224 may include wheels 232 for easy movement of the platform 200 when lifted by the handle 230.

With reference to FIG. 12, operation of the present lateral transfer system 10 is designed to provide lateral stability to the wheelchair or transfer device 12 during patient transfer and prevent overturning of the patient by transforming rotational forces (moments) into an induced bearing pressure between the platform 200 and a floor. This is accomplished by downward bearing of the transfer-side wheel 16 of the transfer device 12 and upward tension shoulders 212 of the bracket 210 which in turn induces bending forces rigid platform 200. The rigidity of the stabilizer system 32 results in transfer of internal bending forces to the floor in the form of a bearing pressure that is dispersed throughout the surface area of the platform 200.

Figure 3:
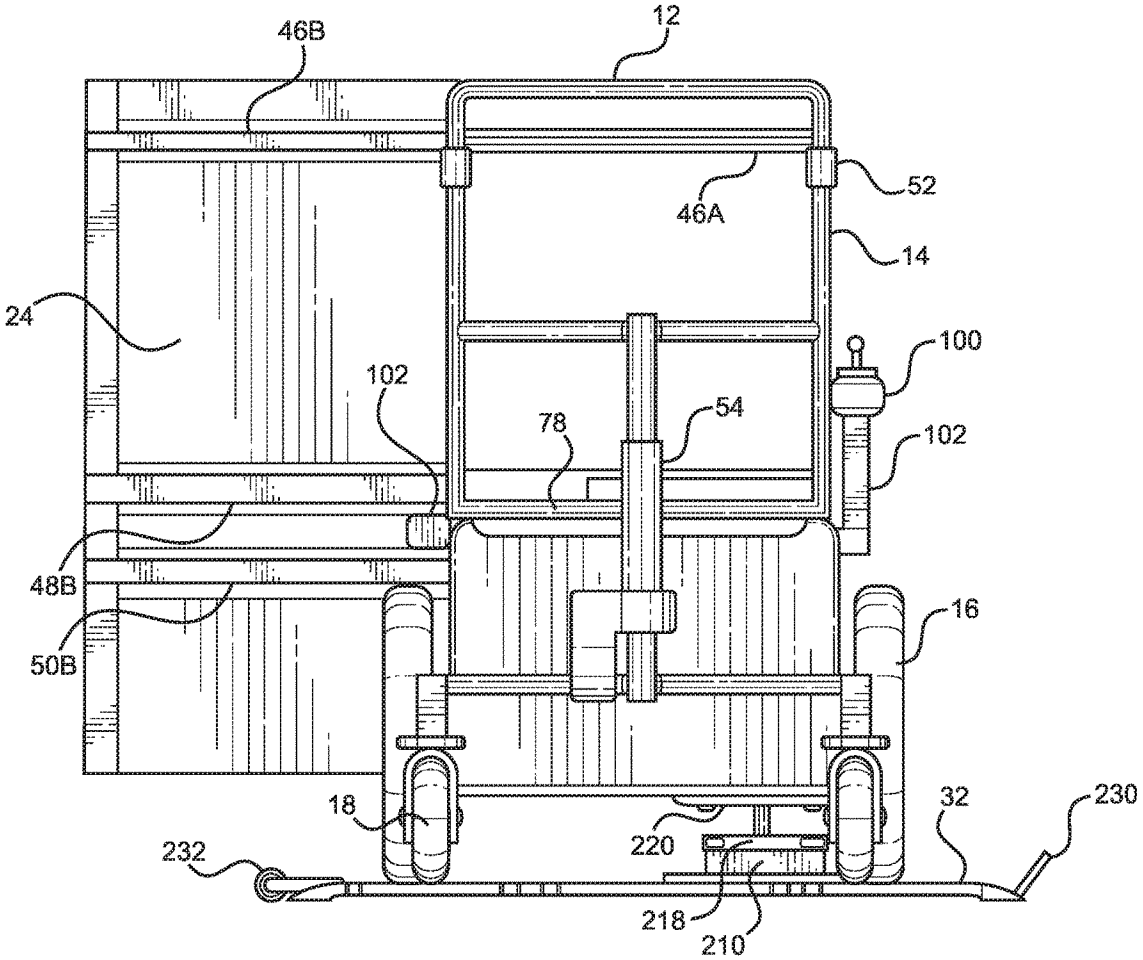
FIG. 3 is a rear elevational view, not to scale, of the lateral transfer system of FIG. 1 with a transfer carriage extended out to one side.

Another feature of the stabilizer system 32 is that the bracket 210 allows movement of the slide plate appendage 218 into the bracket 210 from either side 214 or 216 so that the transfer device may be stabilized on the platform 200 from either a forward or reverse direction as shown in FIG. 11. This aspect of the stabilizer system 32 is extremely important considering the fact that space is often limited when positioning transfer devices 12 for patient transfers. The slide plate appendage 218 may be mounted on the transfer device 12 so that the slide plate appendage 218 is received by the bracket 210 in a manner so that the extended carriage platform 22 is angled slightly downward. The slight angle creates an easier on/off transition for the patient during transfer. The slide plate appendage 218 may be attached to the transfer device 12 or wheel chair between a center portion and an outside edge of the underbelly of transfer device 12 as shown in FIG. 12. Accordingly, the slide plate appendage 218 is mounted on the transfer device 12 on a side opposite from the transfer side as shown in FIGS. 3 and 8. The mounting positions slide plate appendage 218 and bracket 210 are designed to limit the flexing of the platform 200 during a lateral transfer. FIG. 12 further illustrates how the mounting position of the slide plate appendage 218 permits attachments 234 used by other docking devices to remain functional.

The stabilizer system 32 differs from other patented wheelchair docking systems as follows: 1. The stabilizer system 32 permits the patient and caregiver to dock a transfer device 12 at a location conducive to any flat surface. 2. The stabilizer system 32 can conveniently be rolled from room to room, house to van, or from a vehicle to wherever it's needed for patient transfer. 3. The stabilizer system 32 allows a wheeled base structure to dock from a forward or reverse direction. 4. The stabilizer system was designed with a focus on lateral stability.

Space or an area of mobility was a major factor in determining the design of the stabilizer system 32. Bedrooms, hotel rooms, hospital rooms, bathrooms, medical treatment rooms, and all areas of reduced space may be problematic for wheelchair accessibility. The stabilizer system 32 described herein was designed to allow the transfer device 12 to dock from a forward or backward entrance therefor allowing a patient and caregiver to have more opportunity to transfer when space is limited. Conventional docking systems require docking from a forward position of the wheeled base structure. Accordingly, the flexible docking features of the disclosed stabilizer system 32 are an important feature with regard to wheelchair accessibility.

Various wheelchair docking devices are confined to operate in an automobile (car, truck, van) and are devised primarily to create front to back stability. The aforementioned docking devices can only dock from a forward entrance. The slide plate appendage 218 of the present stabilizer system 32, once attached to a four wheeled structure, will not impede the functionality of similar docking systems. However, the greatest advantages of the disclosed stabilizer system 32 is the fact that it requires no uncomfortable harness or sling for the patient to be placed into. The stabilizer system 32 offers an alternative solution to the risk involved in the harness/lift option of patient transfer. The portable platform 200 of the stabilizer system 32 is designed not only for docking, but the design makes the device great for travel and convenient for storage. Whereas, transfer lifts are generally awkward to maneuver and transport due to the nature of their size and shape.

Wheeled base structures may be easily rolled onto to the portable platform 200 to a designated position to initiate the lateral transfer process. Docking occurs when the slide plate appendage 218 is engaged with the bracket 210 on the platform 200. The function of this assemblage is to ensure lateral stability of the wheeled structure during the lateral transfer process. A docking apparatus normally limits a patient's transferring capabilities specifically to a docking wheelchair and docking bed, however, embodiments of the present disclosure allow a patient to transfer to a variety of beds, toilets, medical testing units, or gurneys and return to a wheelchair and vice versa and without the use of multiple care givers.

The portable platform 200 may be made of materials such as metals, alloys, fiberglass, or grated materials. While a rectangular shaped platform 200 is show, the platform 200 may have a variety of suitable shapes such as square, round, rectangular, triangular, or of any of the aforementioned shapes with appendages extending from sides thereof. The strength of the portable platform 200 is critical in terms of flexion. Accordingly, the portable platform 200 must remain in contact with the floor or other surface that the platform 200 is resting on to avoid tipping of the transfer device 12 during a patient transfer. Various angular or channeled structures may be used in the construction of the portable platform 200 for additional strength. Lightweight materials are essential in the design of the portable platform 200 to ensure easy mobilization. Wheel Guiding systems, alignment tracks, painted or taped lines may be used on the portable platform 200 to engage a wheeled based device to a docking position. The underneath side of the portable platform 200 may be covered with a protective material to protect the floor surface where patient transfer will take place. The protective material may also be selected to eliminate sliding of the portable platform 200 during the process of docking and patient transfer. In an alternative embodiment, the portable platform may be used with a lifting device to adjust the transfer device 12 to the height needed for patient transfer.

Many styles of conventional docking appendages, such as appendage 234 may be mounted to the transfer device 12 without interfering with the slide plate appendage 218 used for the stabilizer system 32 described herein. Accordingly, conventional docking products may be used and remain operational with the lateral transfer system 10 described herein. The conventional docking products generally include a stud, bolt or rod type of structure that is attached to the wheeled base structures under frame such as attachment 234 (FIG. 12) that will dock with a mounted docking component attached to a fixed or immovable floor type of structure in an automobile. As shown in FIG. 12, the attachment 234 is typically mounted on the midpoint of the under frame of the transfer device 12 whereas the slide plate appendage 218 is off set from the center of the transfer device 12 on the under frame of the device 12 opposite from the transfer side of the device 12. Unlike the bolt design of the attachment 234, the slide plate appendage 210 has a rectangular shape vs bolt design. The slide plate appendage 210 is relatively flat and slides into the bracket 210. The shoulders 212 of the bracket 210 provide increased lateral stability for the transfer device 12 to prevent the transfer device 12 from rotating clockwise or counter clockwise during the lateral transfer process.

The challenge of simplifying the transfer operations while increasing stability during the transfer process involved designing a transfer system 10 that could be operated manually by releasing a safety latch and simply sliding the carriage platform 22 from a deploy position to a stow position with minimal effort by the care provider. The carriage platform 22 may also be configured to operate semi-automatically with only the addition of an actuator 66 to the frame 14. The auto and manual operations are not only simple additions to the wheeled base structure 40 but are also significantly lower in cost as compared to other transfer devices.

The frame 14 containing the telescopic slides 46-50 and carriage platform 22 are designed to be mounted to a variety of wheel based vehicles by use of mounting flanges and sleeves. Accordingly, the frame 14 including the telescopic slides 46-50 and carriage platform 22 may be mounted to an existing manual wheel chair or motorized vehicle or to a bed. A wheeled base structure that uses a single round or square type height adjusting system and/or actuators may be used with the carriage platform 22, frame 14 and telescopic slides 46-50 of the system to lift a patient to a correct height for transfer.

Accordingly, the transfer system 10 describe herein is designed to allow the disabled patient to safely transfer, not only from a wheeled base powered mobile structure to a variety of beds, but also to gurneys, toilets, and medical testing units (MRI, X-Ray etc.). The system 10 is particularly useful for transferring patients that are physically handicapped (paralyzed), recovering from surgery, frail, and/or elderly. The patient may be transferred from a reclining position as well as from a seated position. The telescopic slides 46-50 provide a union between a frame of a wheeled base structure and the carriage platform 22 permitting the carriage platform 22 to operate independently from the wheeled base structure. Hence, the transfer system described herein may be mounted to various beds, and to powered and manual wheelchairs without diminishing the bed's or chair's ability to tilt, elevate, recline, or maneuver a patient to a pressure reduction posture. In another embodiment, the telescopic slides 46-50 may be mounted directly to a wheelchair frame and can be operated manually or by a linear/hydraulic actuator. The telescopic slides 46-50 provide the carriage platform 22 with strength and provide mobility with a minimal amount of friction.

Use of the transfer system 10 as described herein is less likely to aggravate bed sores or other patient injuries during transfers compared to transfers using a slide board or a sling transfer technique. The transfer system 10 may also aid in reducing the number of potential injuries resulting from caregivers lifting patients during the transfer process. The present invention does not require multiple care providers to assist in a patient transfer. Conventional transfer chairs do not provide the everyday mobility and comfort that a power wheelchair incorporates therefore the focus of the present disclosure is to provide the power and conventional wheelchair industry with an improved system of patient lateral transfer.

With regard to the stabilizer system 32, the portable platform 200 is designed to be rolled under the bed or to a specific location on a floor. The wheels 232 and handle 230 on the platform 200 enable a caregiver to easily slide the platform 200 under a bed when not in use and is much more convenient for a caregiver than repositioning a lifting/harness apparatus for each patient transfer. The stabilizer system 32 is sufficient robust to reduce tipping of the transfer device 12 when transferring a patient.

As described in detail above, the stabilizer system 32 includes positive alignment for the wheels of a transfer device 12 and a slot 228 for the wheel 16 of the transfer device 12 to indicate when the transfer device 12 is properly docked on the portable platform 200 so that the slide plate appendage 218 is engaged with the bracket 210.

The previously described embodiments of the present disclosure have many advantages. The foregoing description of preferred embodiments has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention.

What is claimed is:

1. A stabilizer system for a patient transfer device for transferring a patient between a fixed structure and a mobile vehicle or between two mobile vehicles comprising:

a portable platform having two opposing sloped ramps on a first side and a second side thereof, a bracket fixedly attached to the platform adjacent a first end thereof between the sloped ramps, the bracket having opposed shoulders, an entrance side and an exit side opposite the entrance side, wherein the bracket is adapted for receiving a slide plate appendage attached to a wheeled transfer vehicle when the wheeled transfer vehicle is positioned on the platform between the sloped ramps and between the first end and a second end of the ramp, and wherein the second end of the ramp has a length sufficient to prevent tipping of the platform during a patient transfer maneuver between the wheeled transfer vehicle and a fixed structure or mobile vehicle.

2. The stabilizer system of claim 1, wherein the portable platform further comprises wheels attached to the second end of the platform and a handle attached to the first end of the platform for moving the platform to a patient transfer position when the first end of the platform is lifted to engage the wheels with a ground surface.

3. The stabilizer system of claim 1, wherein the slide plate is adapted for attachment to an underside of the wheeled transfer vehicle.

4. The stabilizer system of claim 1, wherein the portable platform further comprises a wheel guide on a surface of the platform for guiding the wheeled transfer vehicle to a transfer position on the portable platform.

5. The stabilizer system of claim 2, wherein the platform further comprises a wheel position indicator thereon to indicate when the slide plate is engaged with the bracket.

6. A lateral transfer system for transferring a patient between a fixed structure and a mobile vehicle or between two mobile vehicles, comprising:

A) a patient transfer device having a frame fixed to wheels and a carriage platform movably attached to the frame, the carriage platform having one or more extendable carriage platform sections for lateral movement of the carriage platform relative to the frame and wheels for transferring a patient between the patient transfer device and a fixed structure or a wheeled vehicle, and B) a stabilizer system for the patient transfer device, the stabilizer system comprising:

a portable platform having two opposing sloped ramps on a first side and a second side thereof, a bracket fixedly attached to the platform adjacent a first end thereof between the sloped ramps, the bracket having opposed shoulders, an entrance side and an exit side opposite the entrance side, wherein the bracket is adapted for receiving a slide plate appendage attached to the frame of the patient transfer device when the patient transfer device is positioned on the platform between the sloped ramps and between the first end and a second end of the ramp, and wherein the second end of the ramp has a length sufficient to prevent tipping of the platform during a patient transfer maneuver.

7. The lateral transfer system of claim 6, wherein the carriage platforms are manually deployable to a patient transfer position.

8. The transfer system of claim 6, wherein the carriage platforms are automatically deployable to a patient transfer position using an actuator mechanism.

9. The transfer system of claim 6, wherein the carriage platforms further comprise telescoping slides for lateral movement of the carriage platform relative to the frame.

10. The transfer system of claim 6, wherein the patient transfer device comprises three separate carriage platform sections that are hingedly connected to one another.

11. The transfer system of claim 10, wherein the carriage platform sections further comprise hook and loop fasteners for attaching cushions to the carriage platform sections for patient comfort.

12. The transfer system of claim 10, wherein each carriage platform section has an upper panel and a lower panel, wherein the patient travels on the upper panel and the lower panel conceals telescopic slides used to laterally move the carriage platform sections.

13. The transfer system of claim 12, wherein the upper panel and lower panel are joined on one end by a nose piece.

14. A process for transferring a patient between a fixed structure and a mobile vehicle or between two mobile vehicles, comprising:

i) providing (A) a patient transfer device having a frame fixed to wheels and a carriage platform movably attached to the frame, the carriage platform having one or more extendable carriage platform sections for lateral movement of the carriage platform relative to the frame and wheels for transferring a patient between the patient transfer device and a fixed structure or a wheeled vehicle, ii) providing B) a stabilizer system for the patient transfer device, the stabilizer system comprising a portable platform having two opposing sloped ramps on a first side and a second side thereof, a bracket fixedly attached to the platform adjacent a first end thereof between the sloped ramps, the bracket having opposed shoulders, an entrance side and an exit side opposite the entrance side, wherein the bracket is adapted for receiving a slide plate appendage attached to the frame of the patient transfer device, and wherein the second end of the ramp has a length sufficient to prevent tipping of the platform during a patient transfer maneuver, iii) positioning the patient transfer device on the platform between the sloped ramps and between the first end and a second end of the ramp so that the slide plate is engaged with the bracket, and iv) operating the carriage platform to laterally move the patient from the patient transfer device to a fixed structure or a mobile vehicle.

15. The method of claim 14, wherein the carriage platform is manually operated.

16. The method of claim 14, wherein the carriage platform is automatically operated.

17. The method of claim 14, wherein the platform includes a wheel position indicator thereon to indicate when the slide plate is engaged with the bracket.

* * * * *